United States Patent [19]

Zoulek

[11] 4,355,315

[45] Oct. 19, 1982

[54] LOG PERIODIC DIRECTIONAL ANTENNA

[76] Inventor: James R. Zoulek, 5350 Strohm 21, North Hollywood, Calif. 91601

[21] Appl. No.: 222,244

[22] Filed: Jan. 2, 1981

[51] Int. Cl.[3] ..... H01Q 11/10

[52] U.S. Cl. ..... 343/792.5; 343/878

[58] Field of Search ..... 343/815, 819, 792.5, 343/885, 878

[56] References Cited

U.S. PATENT DOCUMENTS

| | | | |
|---|---|---|---|
| 3,500,423 | 3/1970 | Church | 343/792.5 |
| 4,005,432 | 1/1977 | Beccario | 343/792.5 |
| 4,028,709 | 6/1977 | Berkowitz et al. | 343/819 |

*Primary Examiner*—Eli Lieberman

*Attorney, Agent, or Firm*—Hugh D. Jaeger

[57] ABSTRACT

Log periodic directional antenna provides a signal gain in one direction compared to an elementary dipole antenna and over a wide range of frequencies when connected to a transmitter or receiver. An antenna mount supports the antenna on a mast which can be set up at either a fixed location or set up quickly at itinerant sites. The antenna mount is positioned in the substantially mid-portion of the antenna boom providing for mechanical balance. The antenna mount provides for either horizontal or vertical polarization and requires no tools for effecting a change of polarization. The directional antenna can be used for frequencies of 10–1000 MHZ, and particularly lends itself to VHF and UHF frequencies. The directional antenna can also be used for direction finding.

8 Claims, 3 Drawing Figures

LOG PERIODIC DIRECTIONAL ANTENNA

FIELD OF THE INVENTION

Present invention relates to an antenna and, more particularly, pertains to a log periodic directional antenna for either horizontal or vertical polarization.

BACKGROUND OF THE INVENTION

Prior art antennas have usually had a fixed polarization being either horizontal or vertical, and have not provided for effecting change of polarization once installed. This has provided for very undesirable operation when affecting a "DF" of a station.

Prior art antenna mounts usually have consisted of a U-bolt arrangement around the mast of the antenna, and the U-bolt arrangements did not always provide for easily effecting a change of vertical or horizontal polarization. Usually the antenna was designed either for vertical or horizontal polarization only with the U-bolts mounting through the mast or about the mast, and did not permit operation in the opposite polarization than what the antenna was manufactured for a predetermined polarization. Consequently, the antenna was required to be used in either a vertical or horizontal polarization but not both.

Prior art antennas also have been manufactured of angle iron and aluminum. The elements are connected to the boom in such a manner that the connections are subject to corrosion and after time prohibit the changing of the antenna, let alone that changing the polarization of such was impossible. Also, some antennas were mounted at one end of the mast providing minimum mechanical balance and requiring maximum time for installation thereof.

The present invention overcomes the disadvantages of prior art by providing a log periodic directional antenna suitable for use in either vertical or horizontal polarization, and providing an antenna mounting bracket which effects change between vertical or horizontal polarization for use at itinerant locations.

SUMMARY OF THE INVENTION

The general purpose of the present invention is to provide a log periodic directional antenna mountable for either vertical or horizontal polarization, being of a transportable nature, and being supported on a mast by a single individual.

According to one embodiment of the invention, there is provided a log periodic directional antenna including two opposing U-shaped channel booms, a wooden member disposed therebetween, a plurality of log periodic yagi antenna elements disposed along the longitudinal boom, the lengths of the antenna having a log periodic mathematical relationship, each half of each element disposed on opposing booms with respect to each other, and each adjacent element disposed on an opposing boom with respect to each other, coaxial cable connected to two halves of one of the log periodic elements, two pairs of boom mounting bolts connected through orthogonal sides of the boom in a substantially mid-portion of the boom, the coaxial cable protruding out through a mid-portion of the boom, and an antenna mounting pole having a longitudinal cylindrical member, a metal cylindrical member of larger diameter than the longitudinal cylindrical insulating member providing for a fixation onto the same for increased height, a solid core insulating member disposed in the hollow cylindrical insulating member, and an oval plate orthogonally affixed to said solid cylindrical member by a plurality of screws and including two mounting holes for engaging said bolts of said boom whereby the antenna mounting plate accepts the boom of the log periodic direction finding antenna for either vertical or horizontal polarization and the mounting pole provides for rotation of the antenna in either a vertical or horizontal polarization.

A significant aspect and feature of the present invention is a log periodic directional antenna providing for either vertical or horizontal polarization, and mechanically balanced about an antenna mounting bracket on the antenna pole. The log periodic directional antenna is easily transportable and easily rotatable when in use, and does not require any tools for installation or use.

Another significant aspect and feature of the present invention is a log periodic directional antenna having a stainless steel boom and stainless steel elements of a flexible nature providing for safety to DF-er and adjacent individuals, and also adjacent property.

A further significant aspect and feature of the invention is an antenna mount which is easily and quickly installed providing for antenna mounting in either a vertical or horizontal position. The antenna mount does not interfere with the radiation pattern of the log periodic antenna.

Having thus described one embodiment of the present invention, there is provided a log periodic directional antenna and an antenna mount on a mounting pole for an antenna providing for either horizontal or vertical polarization.

An object of the present invention is to provide a log periodic antenna for use in direction finding, receiving, and transmitting, which is mountable on either a vertical or horizontal position at a substantially mid-portion of the antenna and is of light weight providing for installation with minimum time and minimum effort.

Another object of the present invention is to provide an antenna mount providing for antenna mounting of minimum time and minimum effort and provides for antenna polarization either in horizontal or vertical mode with an associated boom and which does not interfere with the radiation pattern of the antenna.

A further object of the present invention is a log periodic directional antenna with an antenna mount on a hand-held pole which provides for use of the log periodic antenna in either a vertical or horizontal polarization and the antenna having a plurality of periodic elements on a boom which is of minimal weight providing for hand-held operation in either a fixed or a mobile location.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof and wherein.

DESCRIPTION OF THE EMBODIMENTS

Figure 1:
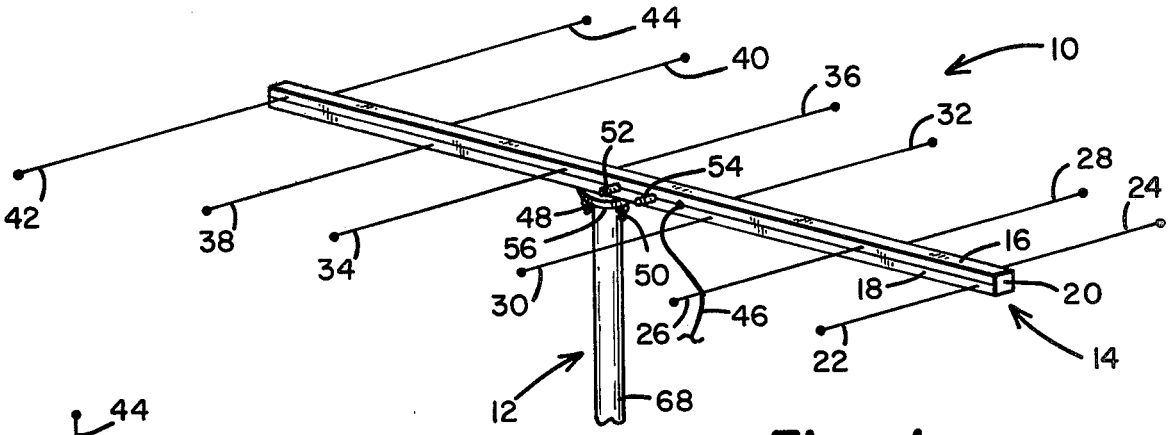
FIG. 1 illustrates a perspective view of a log periodic antenna on an antenna mounting having horizontal polarization.

FIG. 1, which illustrates a perspective view of a log periodic antenna 10 fixed to antenna mount 12 of the present invention, shows the log periodic antenna 10 in a horizontal polarization. The log periodic antenna 10 includes a boom 14 having two U-shaped stainless steel channel members 16 and 18, and a longitudinal length disposed about a wooden core 20. A plurality of log periodic elements ranging from a shorter length to a longer length position about the opposing halves of the boom is illustrated. Each element is composed of two half elements and is of a stainless steel spring-type material having balls at the end of each element for protecting individuals and property. The shortest log periodic element is composed of two halves 22 and 24 where each of the halves is disposed on opposing booms by soldering on the inside thereof where element 22 is affixed to the lower boom and element 24 is affixed to the upper boom. The second element is composed of two elements 26 and 28 where element 26 is affixed to the upper boom and element 28 is affixed to the lower boom. Likewise the alternating of elements between the upper and lower opposing booms continues from the shortest element to the longest element in a likewise progression. A coaxial cable 46 having a suitable connector at one end enters into the substantial mid portion of the boom and connects to two of the elements 22 and 24. The cable runs along the wooden boom and is soldered to two of the element halves 22 and 24. Two pairs of antenna mounting bolts 48 and 50 and 52 and 54 provide for mounting of the antenna 10 to the antenna mount 12 including mounting plate 56. The antenna mounting bolts 48 through 54 can be nylon bolts providing for corrosion resistance. The bolts 48–50 illustrated in FIG. 3 engage within and protrude through holes 58 and 60 of mounting plate 56 and are secured thereto with nuts 70 and 72.

Figure 2:
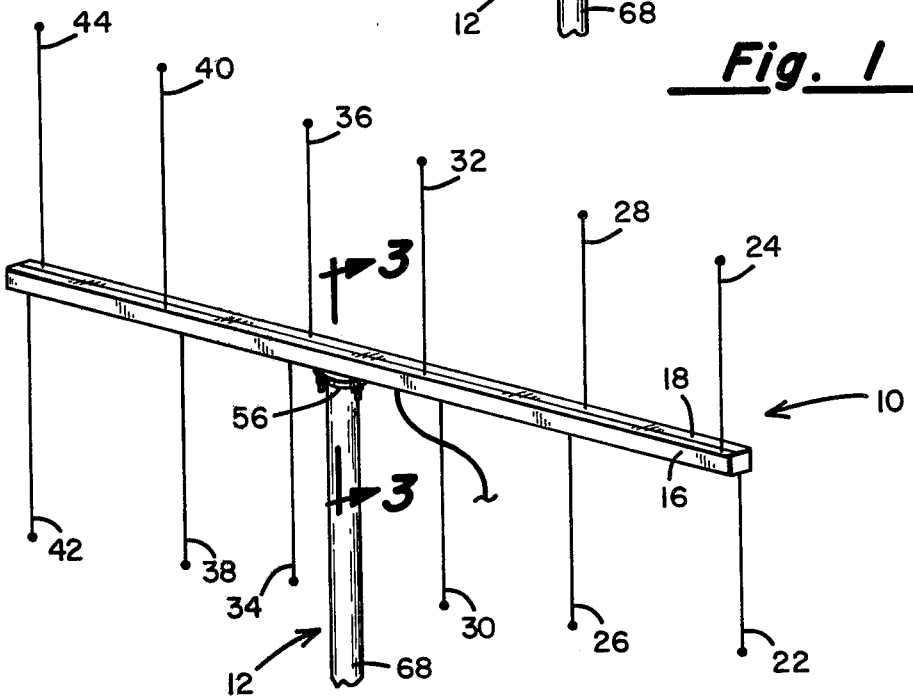
FIG. 2 illustrates the log periodic antenna on an antenna mount having vertical polarization; and, FIG. 3 illustrates a cross-sectional view of the antenna boom and antenna mount with the antenna boom separated from the antenna mount.

FIG. 2, which illustrates a perspective view of log periodic antenna 10 on the antenna mount 12 shows the log periodic antenna 10 mounted for vertical polarization. All numerals correspond to those elements previously described.

Figure 3:
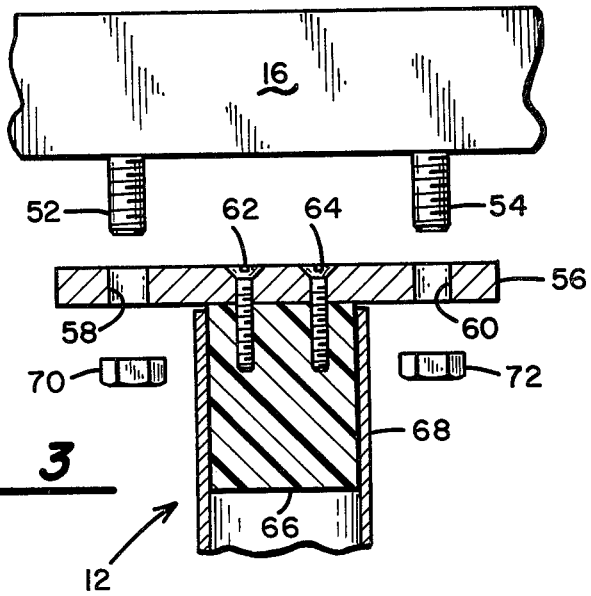

FIG. 3, which illustrates a sectional view taken along line 3—3 of FIG. 2, shows the antenna mount 12 including the antenna mounting plate having an oval configuration by way of example and for purposes of illustration only secured to a solid cylindrical member 66 with screws 62 and 64, the solid cylindrical member frictionally engaged within a longitudinal tube 68. The antenna mounting plate 56 includes two holes 58 and 60 for accepting either bolts 48 and 50 for horizontal polarization or 52 and 54 for vertical polarization, the bolts being secured therein by nuts 70 and 72.

MODE OF OPERATION

By way of example and for purposes of illustration only and not to be construed as limiting of the present invention, the U-shaped stainless steel channel 16 and 18 has a base dimension of $\frac{5}{8}''$ and a side dimension of $\frac{3}{8}''$ and a longitudinal length of 44 inches. The two stainless steel channels are screwed about the wooden core 20 for being secured thereto. In this specific embodiment, six log periodic elements are illustrated having the lengths of tip-to-tip of $23\frac{1}{2}$ inches, 26 inches, $29\frac{3}{4}$ inches, 33 inches, $34\frac{3}{4}$ inches, and 39 inches, and spacings from the shortest length to the longest length of $6\frac{3}{4}$ inches, $7\frac{5}{8}$ inches, $8\frac{1}{8}$ inches, $9\frac{1}{2}$ inches, and 10 inches respectively from the shortest to the longest elements. The coaxial cable having a B and C connector on one end extends through a substantial mid portion of the boom through a slit in the wooden core 20 and connects to the shortest elements. The dimensions are for operation in the VHF frequency range and not to be construed as limiting of the present invention, as other dimensions would be utilized for operation in the UHF range. Dimensions are also for the band of 140 to 190 MHZ having a gain of 2 to 6 DB for covering the high band VHF frequency range utilized by the majority of two-way radio users.

The antenna 10 is affixed to the antenna mount 12 where the antenna 10 mounts at the center providing for excellent balance and minimal installation time from either a mobile or a fixed location, and provides for less stress placed on the mast 68 or the bearings holding the antenna and antenna mount.

For UHF operation, appropriate reduction in size would be provided for a range of approximately 350 to 600 MHZ providing for gain up to 5.5 DB in the UHF frequency range utilized by two-way radio users, as later set forth in this specification.

In operation, it is only necessary to determine the polarization of the antenna and appropriately mount the antenna as illustrated for horizontal polarization in FIG. 1 or for vertical polarization in FIG. 2. The nuts 70 and 72 secure the bolts 48 and 50 for horizontal polarization or 52 and 54 for vertical polarization against the oval mounting plate 56 of the antenna mount 12. Disassembly is the reverse operation of the steps previously described.

Various modifications can be made to the antenna of the present invention without departing from the apparent scope thereof. For instance, any type of antenna may be used with the antenna mount 12 of the present invention and is not limited to a log periodic array. Also, a specific frequency is determined by the user and is not within the realm of those previously described. Finally, materials and dimensions can be varied in achieving the end result under the disclosed teaching for a portable antenna having both polarizations with the described antenna mount. Antenna mount can be made from plastic or any other suitable material having insulating qualities. Stainless steel is not required for use in the boom and the elements but is most desirable against corrosion and providing for lightweight and sturdy construction.

The UHF log periodic version of the disclosed directional antenna includes a length of 41.75 inches, elements alternatively offset at 2.5, 2.75, 3, 3.75, 3.5, 4.5, 4.5, 5.5, 5.5, and 6.25 and including lengths of 4.5, 4.75, 5.75, 6, 6.5, 7.25, 8, 8.75, 9.75, 10.75, and 11.75 inches respectively.

Having thus described the invention, what is claimed is:

1. In combination, a log periodic antenna and an antenna mounting for supporting said log periodic antenna, the combination comprising:

a. log periodic antenna including an upper and lower steel channel, rectangular boom, a wooden core disposed therebetween, a plurality of twelve log periodic alternatively offset steel elements affixed and electrically secured on opposing sides thereto along a longitudinal length of said boom, said elements alternatively positioned on opposing sides of said channel, coaxial feed line connected to two opposing short end elements, said coaxial line running through said interior wooden core of said boom and exiting at a substantially mid portion of said boom, and two bolts positioned parallel to said elements and exiting out at a mid portion from said boom, two bolts orthogonally positioned to said first bolts and exiting out substantially at said mid portion of said boom; and, b. antenna mount including a substantially oval shaped member and including two holes for engaging said orthogonal pairs of bolts on said antenna boom, said oval member perpendicularly affixed to a cylindrical member, said cylindrical member having a diameter and frictionally engaged in a supporting member whereby said mount provides for mounting of said antenna for either horizontal polarization or vertical polarization thereby engaging said bolts in said boom through and protruding from said holes in said antenna mount and being secured thereby with nuts providing for balance of said antenna at first and second polarizations at mobile locations and said alternatively positioned elements on opposing sides of said channels of said boom and alternating along said length of said boom thereby providing a log period effect with wide bandwidth.

2. The combination of claim 1 wherein said antenna is a VHF log periodic.

3. The combination of claim 1 wherein said antenna is a UHF log periodic.

4. The combination of claim 1 wherein said antenna is used for direction finding.

5. The combination of claim 1 wherein said antenna boom is stainless steel.

6. The combination of claim 1 wherein said antenna's elements are stainless steel.

7. The combination of claim 1 wherein said mounting bolts are plastic.

8. The combination of claim 1 wherein said antenna mounting plate is plastic.

* * * * *